United States Patent [19]

Ragland, Jr.

[11] Patent Number: 4,528,475

[45] Date of Patent: Jul. 9, 1985

[54] COLOR PICTURE TUBE HAVING SPRING SUPPORTS FOR A MASK-FRAME ASSEMBLY

[75] Inventor: Frank R. Ragland, Jr., Lancaster, Pa.

[73] Assignee: RCA Corporation, Princeton, N.J.

[21] Appl. No.: 492,636

[22] Filed: May 9, 1983

[51] Int. Cl.[3] ..... H01J 29/07

[52] U.S. Cl. ..... 313/405; 313/406; 313/407

[58] Field of Search ..... 313/405, 406, 407, 404

[56] References Cited

U.S. PATENT DOCUMENTS

| | | | |
|---|---|---|---|
| 3,492,522 | 1/1970 | Pappadis | 313/406 |
| 3,617,787 | 11/1971 | Emmasingel | 313/405 |
| 3,803,436 | 4/1974 | Morrell | 313/405 |
| 3,935,497 | 1/1976 | Cowles et al. | 313/407 X |

FOREIGN PATENT DOCUMENTS

| | | | |
|---|---|---|---|
| 43-19805 | 8/1969 | Japan . | |
| 114258 | 9/1981 | Japan | 313/406 |
| 1135698 | 12/1968 | United Kingdom . | |

*Primary Examiner*—Palmer Demeo

*Attorney, Agent, or Firm*—E. M. Whitacre; D. H. Irlbeck; L. L. Hallacher

[57] ABSTRACT

An improved color picture tube according to the invention includes an evacuated envelope enclosing an apertured mask attached to a frame which are suspended in relation to a cathodoluminescent screen by novel support means. The tube also includes an electron gun for forming a plurality of electron beams and directing the beams through the mask to the screen. An axis passing through the center of the electron gun and the center of the screen is the longitudinal axis of the tube. The screen also includes a major axis and a minor axis which are perpendicular to each other and perpendicular to the longitudinal axis. The support means includes a plurality of studs embedded in the envelope and spaced around the frame and a plurality of springs. Each spring has an aperture at one end engaged with one of the studs and each spring is attached at the other end to the frame. The improvement comprises the springs being angled with respect to the frame such that the angle between a spring and the frame is of an amount to align a spring-to-frame attachment point when the spring and frame are unheated with the same attachment point when the spring and frame are heated within a plane that is parallel to a plane containing the longitudinal axis of the tube.

4 Claims, 8 Drawing Figures

COLOR PICTURE TUBE HAVING SPRING SUPPORTS FOR A MASK-FRAME ASSEMBLY

BACKGROUND OF THE INVENTION

This invention relates to color picture tubes of the type having a mask attached to a frame which is suspended in relation to a cathodoluminescent screen, and particularly to a support for suspending the mask-frame assembly within the tube.

In these color picture tubes, the accuracy with which the electron beams strike the individual elemental cathodoluminescent screen areas depends, to a great extent, upon the accuracy with which the mask apertures are aligned with the elemental screen areas during operation of the tube. Thus, as the mask expands by reason of thermal effects occasioned by the impact thereon of the electron beams, the resulting misalignment of the mask apertures and elemental screen areas causes a portion of the electron beams to misregister, that is, to impinge upon elemental screen areas other than the ones upon which they were intended to impinge.

Most present day color picture tubes utilize a bimetallic mask mounting assembly, such as described in U.S. Pat. No. 3,803,436, issued to Morrell on Apr. 9, 1974, to move the mask toward the screen, as the mask is heated, to compensate for mask expansion. In this patent, a bimetallic element is connected between a stud embedded in the faceplate panel and the mask electrode. The bimetallic element may be a spring welded directly to the frame or an intermediate member located between the spring and frame.

In a four spring support arrangement, wherein each spring has the same orientation, e.g., all extending either clockwise or counterclockwise relative to the mask-frame assembly, thermal expansion of the springs and frame causes the mask to rotate about the longitudinal axis of the tube. This rotation also causes misregister of the electron beams with the elemental screen areas.

In a three spring support arrangement, wherein the side springs both either extend upwardly or downwardly and a top spring extends toward either side, thermal expansion of the mask and springs cause shifts along the major and minor axes of the tube. Such shifts also cause misregister of the electron beams with the elemental screen areas.

To date, the aforementioned problems of rotation about the longitudinal axis and shifts along the major and minor axes have not been completely solved. The present invention provides improvement in the various spring support systems that at least minimizes rotation and shifts of the mask relative to the screen.

SUMMARY OF THE INVENTION

An improved color picture tube according to the invention includes an evacuated envelope enclosing an apertured mask attached to a frame which are suspended in relation to a cathodoluminescent screen by novel support means. The tube also includes an electron gun for forming a plurality of electron beams and directing the beams through the mask to the screen. An axis passing through the center of the electron gun and the center of the screen is the longitudinal axis of the tube. The screen also includes a major axis and a minor axis which are perpendicular to each other and perpendicular to the longitudinal axis. The support means includes a plurality of studs embedded in the envelope and spaced around the frame and a plurality of springs.

Each spring has an aperture at one end engaged with one of the studs and each spring is attached at the other end to the frame. The improvement comprises the springs being angled with respect to the frame such that the angle between a spring and the frame is of an amount to align a spring-to-frame attachment point when the spring and frame are unheated with the same attachment point when the spring and frame are heated within a plane that is parallel to a plane containing the longitudinal axis of the tube.

DETAILED DESCRIPTION

Figure 1:
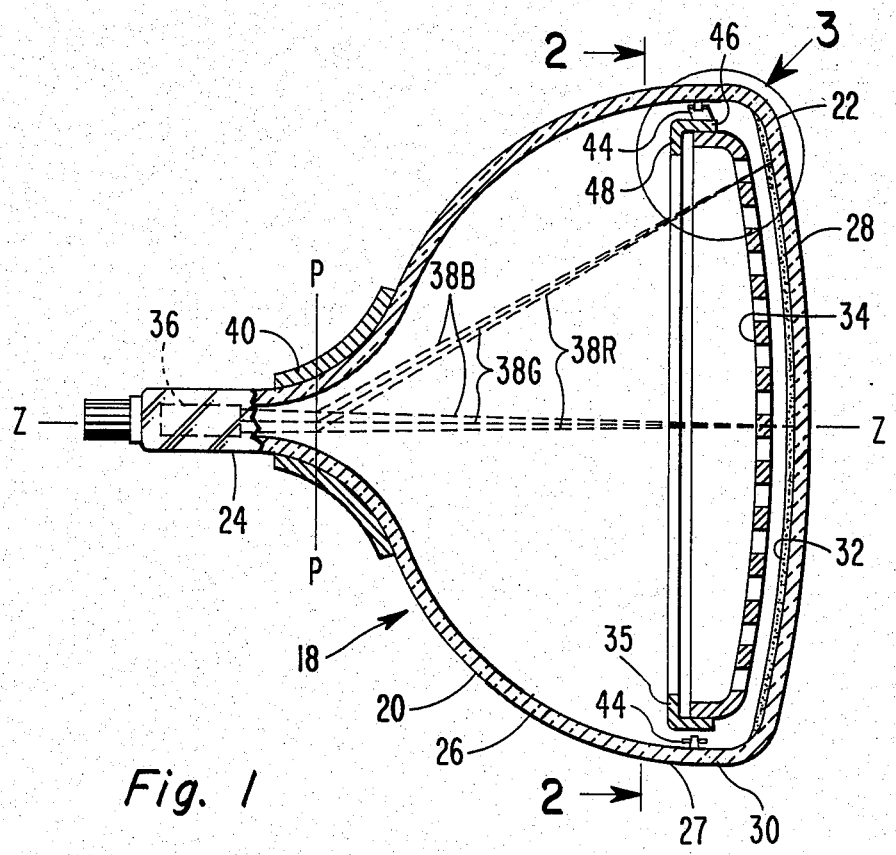
FIG. 1 is a plan view in axial section of an apertured mask cathode-ray tube.

FIG. 1 illustrates a rectangular color picture tube 18 having an evacuated glass envelope 20 comprising a faceplate panel 22 and a tubular neck 24 joined by a funnel 26. The panel 22 comprises a viewing faceplate 28 and a peripheral flange or sidewall 30, which is sealed to the funnel 26 by a frit material 27. A three-color cathodoluminescent line screen 32 is located on the inner surface of the faceplate 28. The screen 32 comprises an array of phosphor lines extending substantially parallel to the vertical or minor axis thereof. Portions of the screen 32 may be covered with a light-absorbing material in a manner known in the art. A multiapertured color selection electrode or shadow mask 34, attached to a frame 35 having an L-shaped cross-section, is removeably mounted within the panel 22 in predetermined space relationship to the screen 32. A novel support for this mask-frame assembly is described in detail below. The mask 34 includes a multiplicity of slit-shaped apertures, which are aligned in substantially parallel vertical columns, and web portions separating the slits of each column.

An inline electron gun 36 (illustrated schematically) is mounted within the neck 24 to generate and direct three electron beams 38B, 38R and 38G along coplanar convergent paths through the mask 34 to the screen 32.

The tube 18 is designed to be used with an external magnetic deflection yoke 40 surrounding the neck 24 and funnel 26 in the vicinity of their junction. When appropriate voltages are applied to the yoke 40, the three beams 38B, 38R and 38G are subjected to vertical and horizontal magnetic fields that cause the beams to scan horizontally, in the direction of the major screen axis, and vertically, in the direction of the minor screen axis, in a rectangular raster over the screen 32. For simplicity, the actual curvature of the paths of the deflected beams in the deflection zone is not shown in FIG. 1. Instead, the beams are schematically shown as having an instantaneous bend at the plane of deflection P-P.

Figure 2:
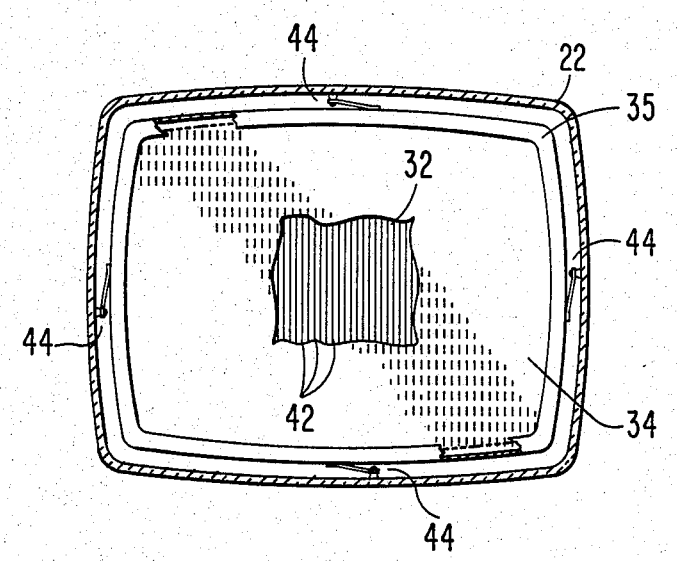
FIG. 2 is a back view of the faceplate and mask-frame assembly of the tube of FIG. 1.

A portion of the screen 32, partially covered by the mask 34, is illustrated in FIG. 2. The screen 32 comprises alternate lines 42 of red-, green- and blue-emitting phosphor elements. Also shown in FIG. 2 are four mask-frame supports 44 (two of which are shown in FIG. 1) that suspend the assembly of the mask 34 and frame 35 within the panel 22.

Figure 3:
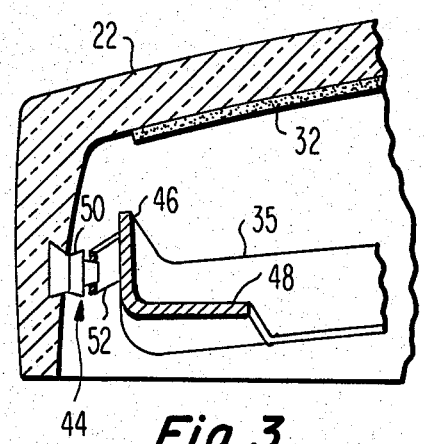
FIG. 3 is an enlarged view of the circled portion, designated 3, of the tube of FIG. 1 without a shadow mask.

The frame 35 has an L-shaped cross-section with a first flange 46 extending toward the screen 32 and a second flange 48 extending inwardly toward the longitudinal axis Z—Z of the tube 18, as shown in FIG. 3.

Each mask-frame support 44 includes a metal stud 50 embedded into a sidewall of the panel 22 and a resilient spring 52. Each spring is welded at one end to the first flange 46 of the frame 35. The other end of each spring includes an aperture 54 which engages the tapered end of a stud 50.

Figure 4:
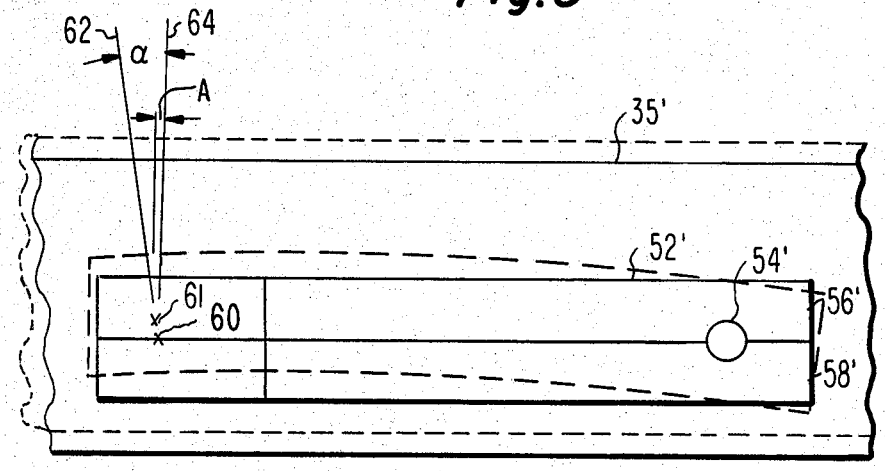
PRIOR ART Fig. 4
FIG. 4 is a side view of a prior art support spring attachment to a frame.

FIG. 4 shows a spring 52′ and a portion of a frame 35′ in a prior art tube. The spring 52′ is of edge-to-edge bimetal construction. One portion 56′ of the spring 52′ has a higher coefficient of thermal expansion then the other portion 58′. The spring 52′ includes an aperture 54′ at one end and is welded to the frame 35′ at the other end. Although springs are usually welded to the frame at two or more points, only one weld point 60 is shown for illustrative purposes. The spring 52′ is oriented so that the long edges of the spring parallel the edges of the frame 35′. When the frame 35′ and spring 52′ become heated during tube operation, they both expand and the spring bends because of its bimetallic structure. Since one end of the spring 52′ is engaged with a stud, the bending of the spring causes the other end of the spring that is welded to the frame to move toward the tube screen. The positions of the frame 35′ and spring 52′, when heated, are shown by the dashed lines in FIG. 4. Because of the expansion of the frame 35′ and the spring 52′ and because of the bending of the spring, the weld point 60 is displaced to a new position 61. In FIG. 4, this new position 61 is left of the original weld point 60 a distance A and slightly above the original weld point 60. A line 62 extending through position 61 and point 60 forms an angle $\alpha$ with a vertical line 64 that passes through point 60. Movement of the weld point 60 to the left as shown causes the aforementioned mask rotation in a four spring support system or mask shift in a three spring support system.

Figure 5:
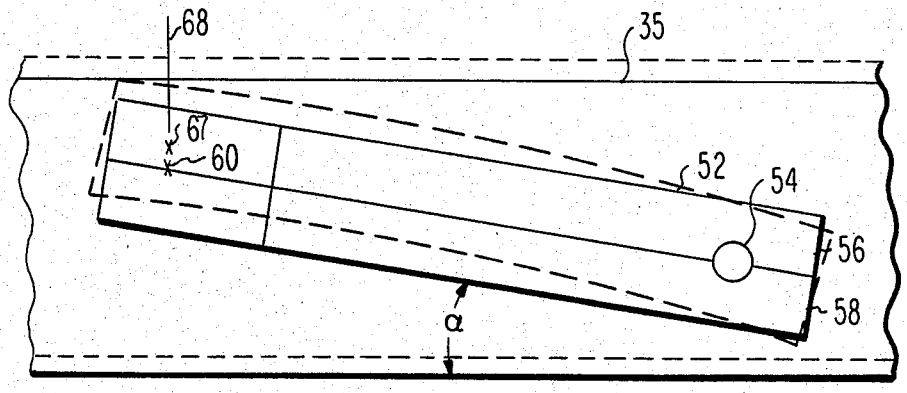
FIG. 5 is a side view of the improved support spring arrangement of the tube of FIG. 1.

The improved spring support means is shown in FIG. 5. In this improved means, the spring 52 is attached to the frame 35 at the angle $\alpha$ which is the same angle as in the prior art tube of FIG. 4. The spring 52 also is of bimetallic construction having two edge-to-edge portions 56 and 58. The spring 52 includes an aperture 54 at one end and is welded to the frame 35 at a weld point 66 at the other end. When heated, the frame 35 and the spring 52 expand and the spring 52 bends thus relocating these components to the positions shown by the dahsed lines in FIG. 5. Because an edge of the spring 52 is angled with respect to an edge of the frame 35 at an angle $\alpha$, the weld point 66 moves in the direction of the longitudinal axis of the tube to the position 67 when the frame and spring are heated. In FIG. 5, the line 68 lies in a plane that is parallel to a plane containing the longitudinal axis of the tube. Thus by appropriately angling the springs with respect to the frame both problems of rotation and shift are avoided or at least minimized.

Figure 6:
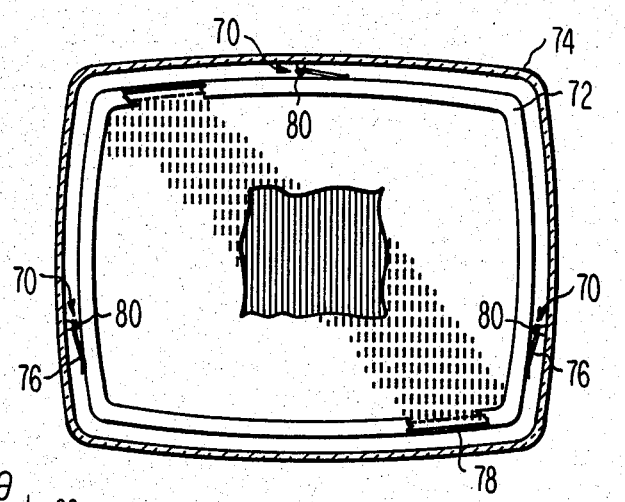
FIG. 6 is a back view of a faceplate and mask-frame assembly of another tube.

Another spring support system is shown in FIG. 6. In this system, three mask-frame supports 70 are utilized to suspend a mask-frame assembly 72 within a faceplate panel 74. Two side springs 76 are attached to a frame 78 and extend upwardly from the sidewall of the panel 74. The top spring 76 also is attached to the frame 78 and engages a stud 80 but extends sideways. The springs 76 may either be edge-to-edge bimetallic springs as previously described or spring-clip type supports as described hereinafter.

Figure 7:
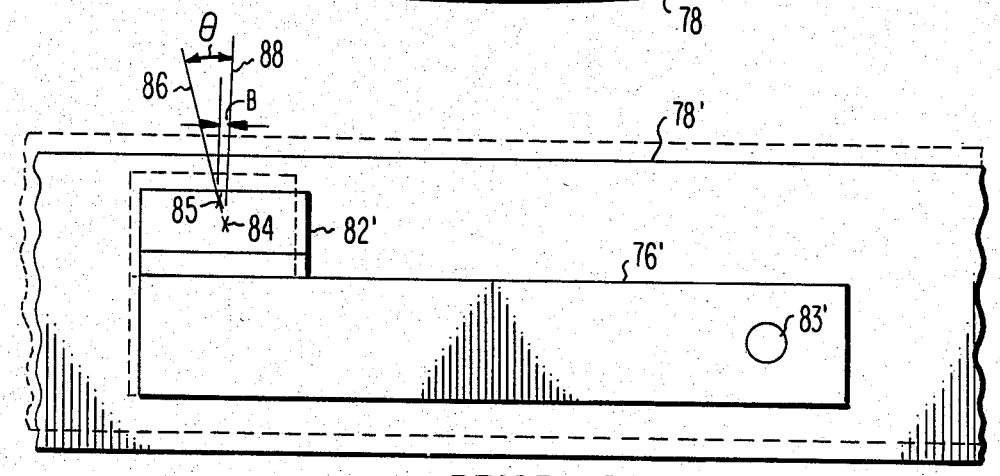
PRIOR ART Fig.7
FIG. 7 is a side view of another prior art support spring attachment to a frame.

FIG. 7 shows a leaf spring 76′, a bimetallic element or clip 82′ and a portion of a frame 78′ in another prior art tube. The spring 76′ is formed from a single material, and the clip 82′ is formed from laminated bimetallic materials. The spring 76′ includes an aperture 83′ at one end, which engages a panel stud, and is welded to a lower portion of the clip 82′ at the other end. The upper portion of the clip 82′ is welded to the frame 78′ at a point 84. The upper and lower portions of the clip 82′ are connected by a loop portion which expands when the clip is heated. When the frame 78′ and spring 76′ become heated during tube operation, they also expand, and the weld point 84 is displaced to a new position 85. In FIG. 7, this new position 85 is left of the original weld point 84, a distance B and slightly above the weld point 84. The dashed lines show the locations of the components when they are heated. A line 86, extending through position 85 and point 84, forms an angle $\theta$ with a vertical line 88 that passes through the point 84. Movement of the weld point 84 to the left, as shown, causes the aforementioned mask rotation or shift.

Figure 8:
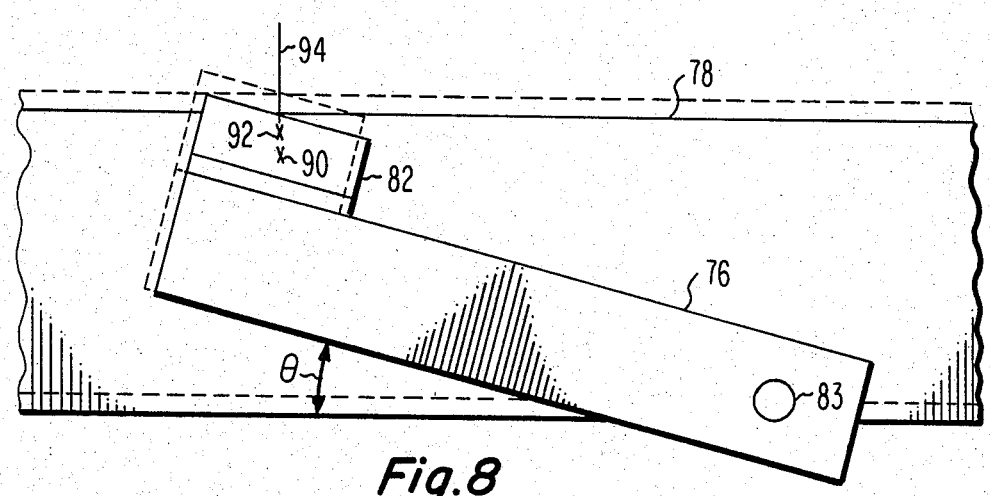
FIG. 8 is a side view of another improved support spring arrangement.

An improved spring support means is shown in FIG. 8. In this improved means, a spring 76 and clip 82 are attached to a frame 78 at the angle $\theta$, which is the same angle as in the prior art embodiment of FIG. 7. Except for the angle of attachment, the spring 76 and clip 82 are identical to the spring 76′ and clip 82′ of FIG. 7. Because of the angle of attachment, a weld point 90, connecting the clip 82 to the frame 78, moves in the direction of the longitudinal axis of a tube containing the assembly to the position 92. In FIG. 8, the line 94 lies in a plane that is parallel to a plane containing the longitudinal axis of the tube. Again, by appropriately angling the springs and clips, with respect to the frame, both problems of rotation and shift are avoided or at least minimized.

Although the preferred embodiments are described herein with respect to a line-screen, slit-aperture-mask type color picture tube, the invention is equally applicable to other types of color picture tubes, such as dot-screen, circular-aperture type tubes or tubes having other type screens combined with other type mask electrodes.

It should also be understood that the novel mask-frame supports may be used with a tube, wherein the frame is an integral portion of the mask, such as may be formed by suitable bending of the mask skirt. Furthermore, although the novel support embodiments described herein will cause the mask to be moved toward the screen when the support is heated, the supports can be used to move the mask away from the screen as the supports are heated by inverting the positions of the springs.

What is claimed is:

1. In a color picture tube of the type including an evacuated envelope enclosing a cathodoluminescent screen, an electron gun and an apertured mask attached to a frame which is suspended in relation to said screen by support means, an axis passing through the center of said electron gun and the center of said screen being the longitudinal axis of said tube, said screen also including a major axis and a minor axis which are perpendicular to each other and perpendicular to said longitudinal axis, said support means including a plurality of studs embedded in said envelope and spaced around said frame, and a plurality of springs, each of said springs having an aperture at one end for engagement with one of said studs and the other end of each of said springs being attached to said frame at an attachment point the improvement comprising:

each of said attachment points lying in individual planes parallel to planes containing the longitudinal axis of said tube, said springs being angled with respect to said frame, the angle between a spring and said frame being of an amount whereby said attachment points remain in said planes when said spring and frame are unheated and when said spring and frame are heated.

2. The tube as defined in claim 1 wherein said springs are constructed of bimetallic materials.

3. In a color picture tube of the type including an evacuated envelope enclosing a cathodluminescent screen, an electron gun and an apertured mask attached to a frame which is suspended in relation to said screen by support means, an axis passing through the center of said electron gun and the center of said screen being the longitudinal axis of said tube, said screen also including a major axis and a minor axis which are perpendicular to each other and perpendicular to said longitudinal axis, said support means including a plurality of studs embedded in said envelope and spaced around said frame, and a plurality of spring assemblies, each being engaged with one of said studs and each being connected to said frame of at least one connection point, the improvement comprising:

each of said attachment points lying in individual planes parallel to planes containing the longitudinal axis of said tube, said spring assemblies being angled with respect to said frame, the angle between a spring assembly and said frame being of an amount whereby said attachment points remain in said planes when said spring assembly and frame are unheated and when said spring assembly and frame are heated.

4. The tube as defined in claim 3 wherein each of said spring assemblies includes a laminated bimetallic element, a first portion of said element being attached to said frame, and a leaf spring having one end attached to a second portion of said bimetallic element, and the other end of said leaf spring including an aperture engaged with one of said studs.

* * * * *